US007304257B2

(12) United States Patent
Chi et al.

(10) Patent No.: US 7,304,257 B2
(45) Date of Patent: Dec. 4, 2007

(54) KINETIC ENERGY TRANSFERRING ELEMENT APPLIED TO A BUTTON STRUCTURE

(75) Inventors: Chih-Yung Chi, Taipei (TW); San-Peng Lin, Taipei (TW); Wei Wu, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 0 days.

(21) Appl. No.: 11/503,904

(22) Filed: Aug. 15, 2006

(65) Prior Publication Data

US 2007/0034490 A1 Feb. 15, 2007

(30) Foreign Application Priority Data

Aug. 15, 2005 (TW) ..... 94127711 A

(51) Int. Cl.
*H01H 13/70* (2006.01)

(52) U.S. Cl. ..... 200/343

(58) Field of Classification Search ..... 200/520, 200/517, 341–345, 296, 339, 522, 533, 553, 200/558, 573, 574; 341/22; 345/156, 168, 345/169

See application file for complete search history.

(56) References Cited

U.S. PATENT DOCUMENTS

| | | | | |
|---|---|---|---|---|
| 5,436,418 | A * | 7/1995 | Tamehira | 200/61.58 R |
| 5,481,074 | A * | 1/1996 | English | 200/5 A |
| 5,495,080 | A * | 2/1996 | Periou et al. | 200/283 |
| 5,552,956 | A * | 9/1996 | Pasquarette et al. | 361/680 |
| 5,752,596 | A * | 5/1998 | Chu | 200/343 |
| 5,912,443 | A * | 6/1999 | Hasunuma | 200/5 A |
| 6,160,232 | A * | 12/2000 | Lin | 200/341 |
| 6,964,532 | B1 * | 11/2005 | Lu | 400/490 |
| 7,019,237 | B2 * | 3/2006 | Hong | 200/296 |
| 7,094,983 | B2 * | 8/2006 | Tsunemoto | 200/339 |

* cited by examiner

*Primary Examiner*—Michael A Friedhofer
(74) *Attorney, Agent, or Firm*—Birch, Stewart, Kolasch & Birch, LLP

(57) ABSTRACT

A kinetic energy transferring element applied to a button structure for pressing an electric switch has a curved portion, a first extended portion and a second extended portion, in which the curved portion is bridged between the first extended portion and the second extended portion. The first extended portion is served as a fulcrum of the transferring element, while the second extended portion is a free end to receive foreign application. When the user presses the second extended portion, the curved portion of the kinetic energy transferring element can protrude to touch the electric switch.

14 Claims, 5 Drawing Sheets

KINETIC ENERGY TRANSFERRING ELEMENT APPLIED TO A BUTTON STRUCTURE

FIELD OF THE INVENTION

The present invention relates to a button structure, and more particularly applied to a kinetic energy transferring element which has a plurality of touching faces.

BACKGROUND OF THE INVENTION

Along with technical progress, the computer has become one of the indispensable electronic products to the modern people. In particular, the notebook computer (also, simplified as the notebook) becomes a best partner for the commercial person in work.

In conventional notebook designs, some quick-operated buttons on lateral sides such as switches, wheel for adjustment volume or buttons for disc operation are usually seen. These buttons normally only have one touching face, and thus are easy to fatigue after a long-term operation. Because each of the buttons only has a single touching face, the user must press the touching face in a right direction. If the user ill-presses the button, the button is usually unable to function.

Referring to FIG. 1*a*, a perspective view of a conventional notebook is shown. The notebook 1 includes an upper housing 101, a base housing 102, a display screen 11, an operation panel 12 and at least a button structure 13, in which the button structure 13 sets at a lateral side of the lower housing 102.

Referring to FIG. 1*b*, a sectional view of the conventional button structure of the notebook taken along an AA' line of FIG. 1*a* is shown. The button structure 13 includes an elastic plane 131 and a printed circuit board 132.

As shown, the internal space provided by the housing 10 accommodates the elastic plane 131 and the printed circuit board 132 of the button structure 13. The elastic plane 131 is a soft plastics plane having an upper side fixed at the housing 10 and an opposing lower side (defined as a pressing plane 1311) having a protruding portion 1312 downward away the housing 10.

The printed circuit board 132 is located below the elastic plane 131, and an electric switch 1322 is mounted on top of the printed circuit board 132 with a predetermined spacing to the protruding portion 1312. When the user presses the elastic plane 131 as well as the protruding portion 1312, the movement would force the central of the protruding portion 1312 to touch or trigger the electric switch 1322 so as to have the electric switch 1322 to further function a respective switch of the printed circuit board 132.

Though the aforesaid button structure 13 merely receives the power from each single depression. However, after being repeatedly operated, the button structure 13 will fatigue to lose its sensitivity and cause a final dysfunction of the button. In particular, for the elastic plane 131 is a wide-spanned elastic shell structure, so the elastic plane 131 would be concavely deformed gradually and finally reach a dead point that the protruding portion 1312 permanently solidly connects with the switch 1322. Also, by means of the depression movement to solidly touch the switch 1322 for trigger the designated function, the printed circuit board 132 can be also bent accordingly and thus possible mis-functioning the other switches thereon can occur.

SUMMARY OF THE INVENTION

The object of the present invention is to provide a button structure applying a kinetic energy transferring element which has a plurality of touching faces.

In accordance with the present invention, the kinetic energy transferring element applied to a button structure for pressing an electric switch has a curved portion, a first extended portion and a second extended portion, in which the curved portion bridges the first extended portion and the second extended portion. The first extended portion is served as a fulcrum. When the user presses the second extended portion, the curved portion of the kinetic energy transferring element can protrude to touch the electric switch.

In a preferred embodiment, the kinetic energy transferring element further comprises a protruded portion which is a plate and connects with the curved portion for touching downward the electric switch of the protruded portion. In the present invention, the protruded portion can be shaped as a square, a circle, and a polygon. In particular, the protruded portion further has a protruded cross ribs for touching the electric switch.

In a preferred embodiment, the kinetic energy transferring element can be made of a plastics or a metal and can be formed as a U shape, V shape, or W shape. In the present invention, the electric switch is mounted on a printed circuit board.

In a preferred embodiment, the first extended portion has a plurality of holes for mounting respective thermal-melt pillars of an up-housing. Beside, the second extended portion has a plurality of touching faces. When the user presses any touching face, the curved portion of the kinetic energy transferring element can protrude to touch the electric switch.

In another preferred embodiment, a button structure in a electron device comprises a kinetic energy transferring element, a printed circuit board and a housing. The kinetic energy transferring element has a first extended portion, a second extended portion, a protruded portion, and a curved portion to bridge the first extended portion and the second extended portion. The first extended portion is served as a fulcrum, and the protruded portion is located in the middle of the curved portion.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCCRIPTIONS OF THE PREFERRED EMBODIMENT

The present invention is related to a button structure, more particularly to a structure that applies a kinetic energy transferring element having a plurality of touching faces for providing a user able to touch the button structure in arbitrary directions. The button structure of the present invention, applicable to notebook computers or other electron devices, is usually set in the sidewall of the device and plays as a medium for a user to touch the electric switch located inside the device.

Figure 1A:
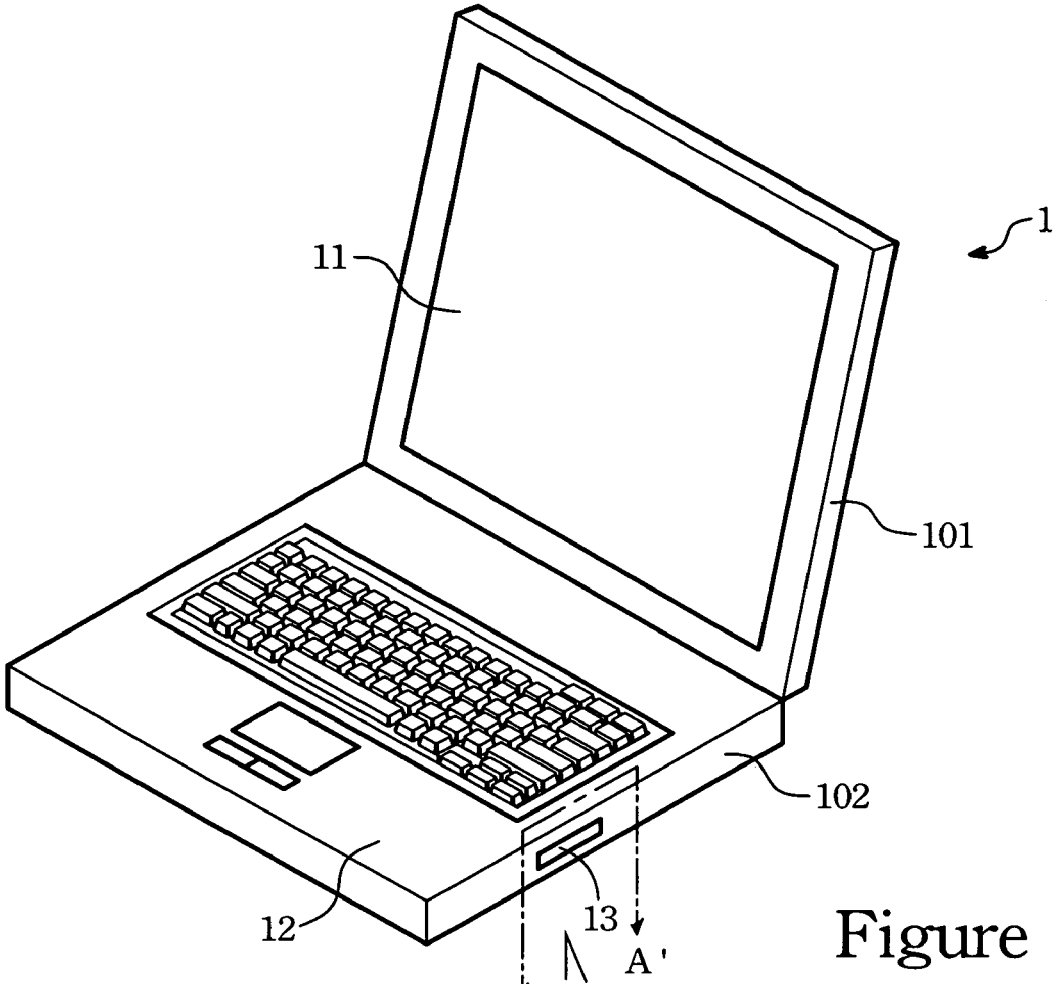
Figure 1 a ( Prior Art )
FIG. 1*a* is a perspective view of a conventional notebook computer.
Figure 1B:
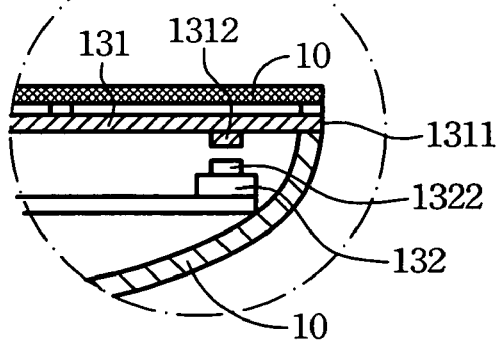
Figure 1 b ( Prior Art )
FIG. 1*b* is a fragmentary sectional view of FIG. 1*a* along line AA'.
Figure 2A:
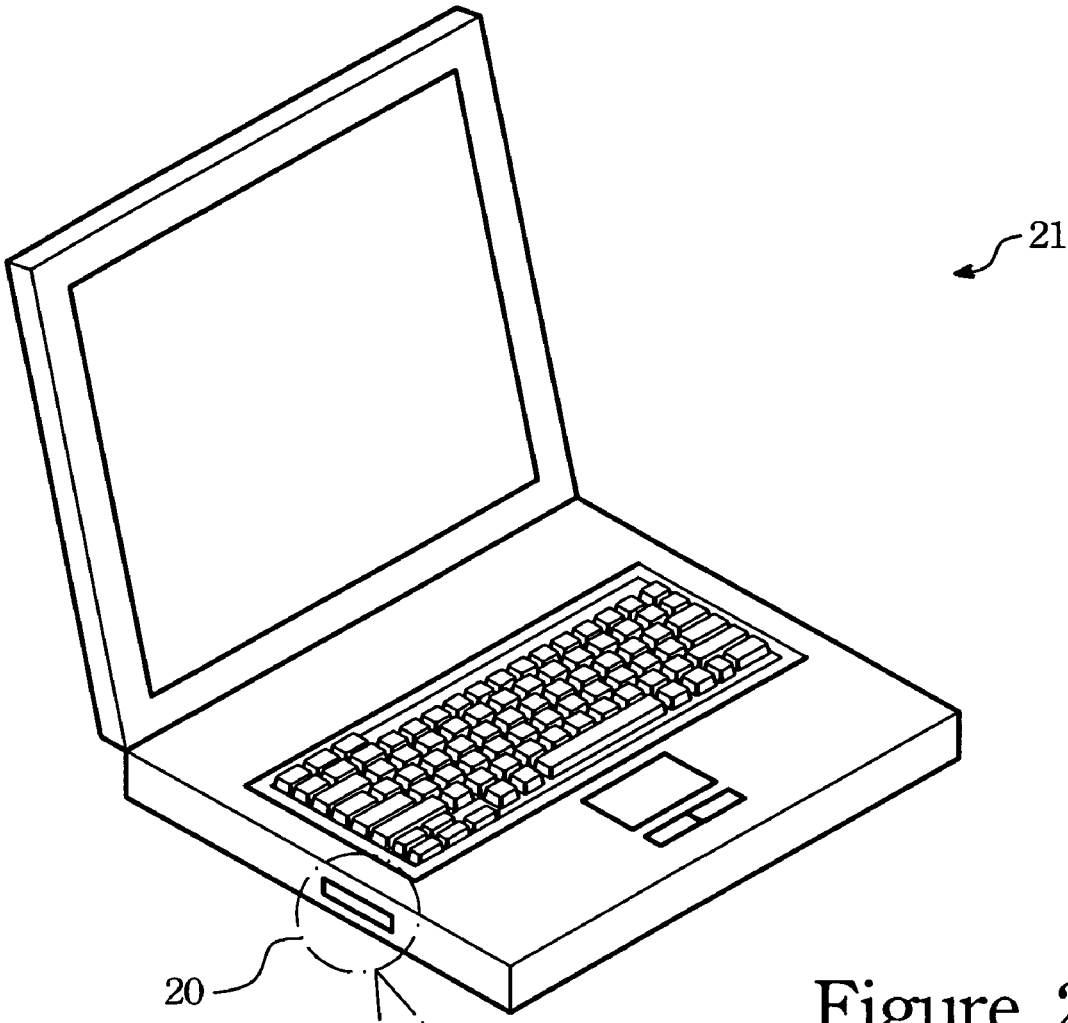
FIG. 2*a* is a perspective view of a preferred embodiment of the button structure of the present invention.

Referring to FIG. 2*a*, a preferred button structure of the present invention is shown to be set at a sidewall of the notebook for operating the switch or other functions of notebook 21.

Figure 2B:
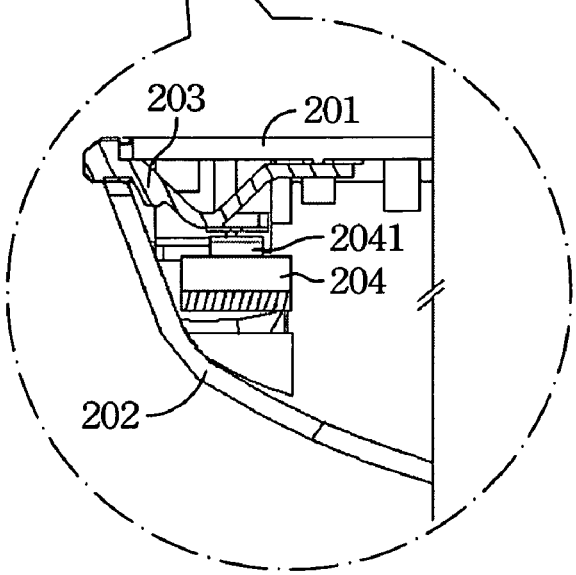
FIG. 2*b* is a fragmentary sectional view of FIG. 2*a;*

Referring to FIG. 2*b*, a sectional view of the button structure 20 of FIG. 2*a* is shown. The button structure 20 includes an up-housing 201, a down-housing 202, a kinetic energy transferring element 203 and a printed circuit board 204. As shown, by providing the up-housing 201 and the down-housing 202, an interior room can be formed to accommodate the kinetic energy transferring element 203, the printed circuit board 204 and other electronic elements. The kinetic energy transferring element 203 is a plate structure and is set on the inside surface of the up-housing 201. The printed circuit board 204 is set under the kinetic energy transferring element 203 and an electric switch 2041 for receiving a downward touch from the kinetic energy transferring element 203 is mounted on the printed circuit board 204.

Figure 3A:
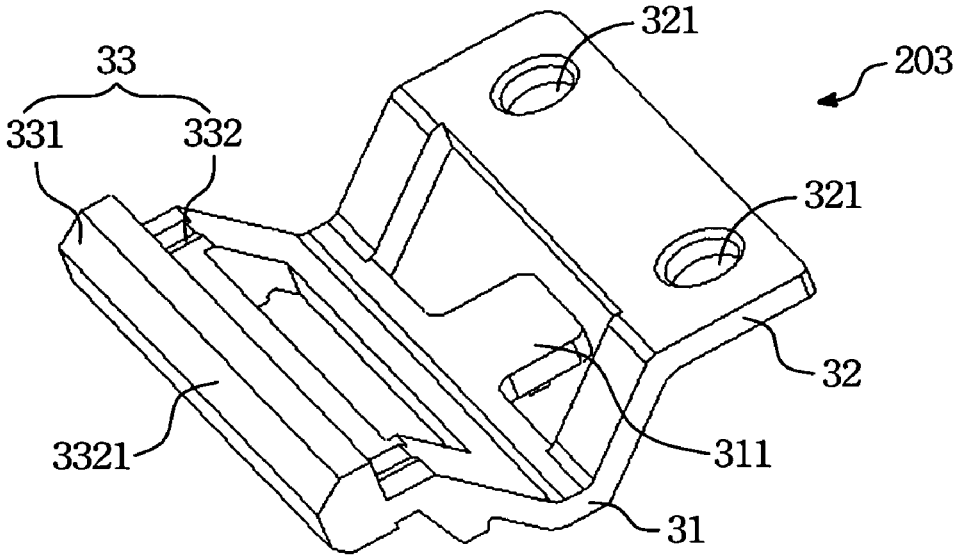
FIG. 3*a* is a perspective view of the kinetic energy transferring element of FIG. 2*b;*
Figure 3B:
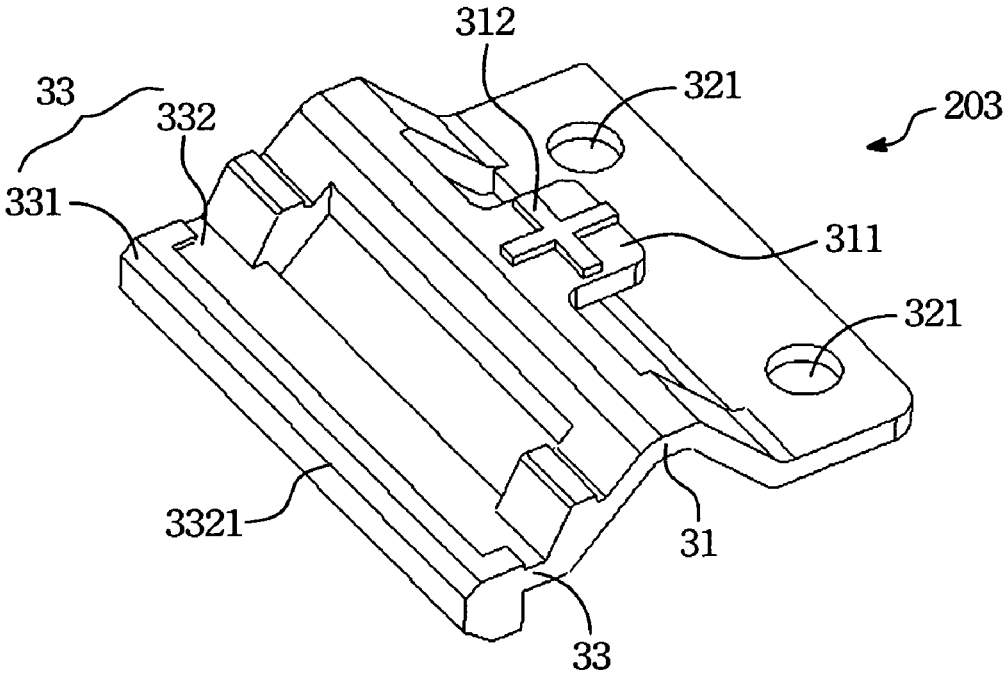
FIG. 3*b* is another perspective view of the kinetic energy transferring element of FIG. 3*a;*
Figure 3C:
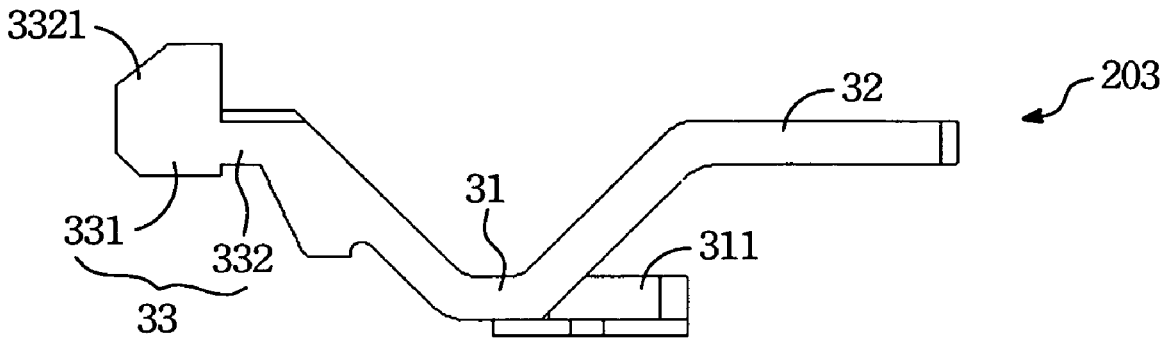
FIG. 3*c* is a planar lateral view of the kinetic energy transferring element of FIG. 3*a;*

Referring to FIGS. 3*a*~3*c*, two perspective views from different angles and a planar lateral view of the kinetic energy transferring element 203 of the present invention are shown. The kinetic energy transferring element 203 includes a curved portion 31, a first extended portion 32 and a second extended portion 33, in which the curved portion 31 is located between the first extended portion 32 and the second extended portion 33. The curved portion 31 can be a V shape portion and each side of the V shape portion further has an opening.

The first extended portion 32 can further have a plurality of holes 321 (two shown in this embodiment) for screws or other fasteners to mount the first extended portion 32 to the up-housing 201. The second extended portion 33 includes an edge 331 with a polygon cross section (called the polygon edge 331 thereafter) and a plane plate 332. The plane plate 332 connects to the curved portion 31 at one side while the first extended portion 32 connects to the curved portion 31 at another side. The polygon edge 331 lying in a full span wise along the free edge of the second extended portion 33 next to the plane plate 332 can provide a plurality of touching faces for the user to press thereupon. When the button structure is assembled, the polygon edge 331 of the button structure 20 is just protruded out of a slit aperture (i.e. the button opening of the notebook housing) formed by spacing the up-housing 201 and down-housing 202 (as shown in FIG. 2*b*).

The bottom of the curve portion 31 can further include a protruded portion 311 formed as a horizontal tongue structure in the opening of one wing of the V-shape structure close to the first extended portion 32. In the embodiment, the protruded portion 311 is formed parallel to the first extended portion 32 and has a protruded cross ribs 312 on the surface for touching downward the electric switch 2041 with a minimum touching surface manner so as not to touch other switches of the printed circuit board 204.

Figure 3D:
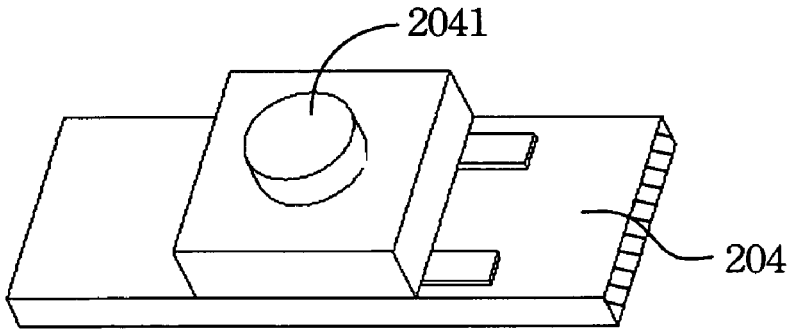
FIG. 3*d* is a perspective view of a preferred printed circuit board in accordance with the present invention.

Referring to FIG. 3*d*, a perspective view of the printed circuit board according to the present invention is shown. The electric switch 2041 is set on the printed circuit board 204 for electrically and solidly touching the protruded portion 311. The electric switch 2041 is located to properly face the protruded portion 311.

Figure 4A:
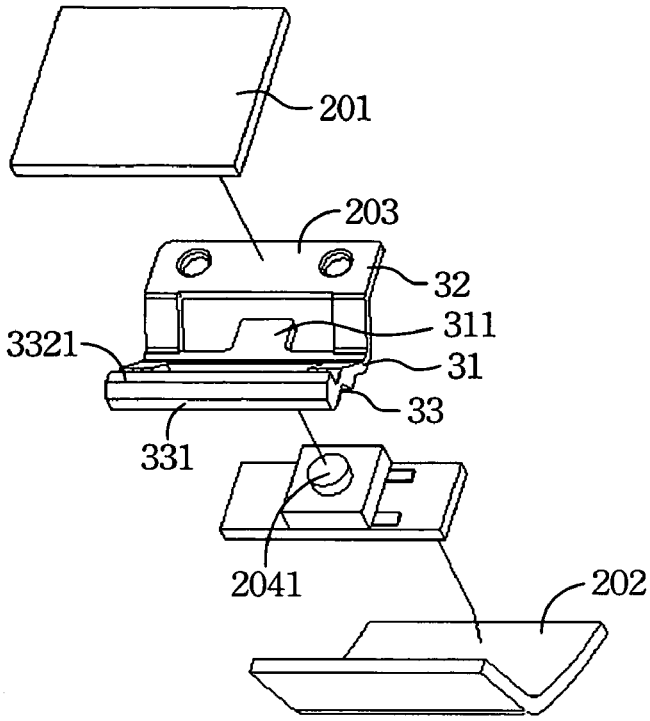
FIG. 4*a* is an exploded perspective view of the button structure of FIG. 2*b*.
Figure 4B:
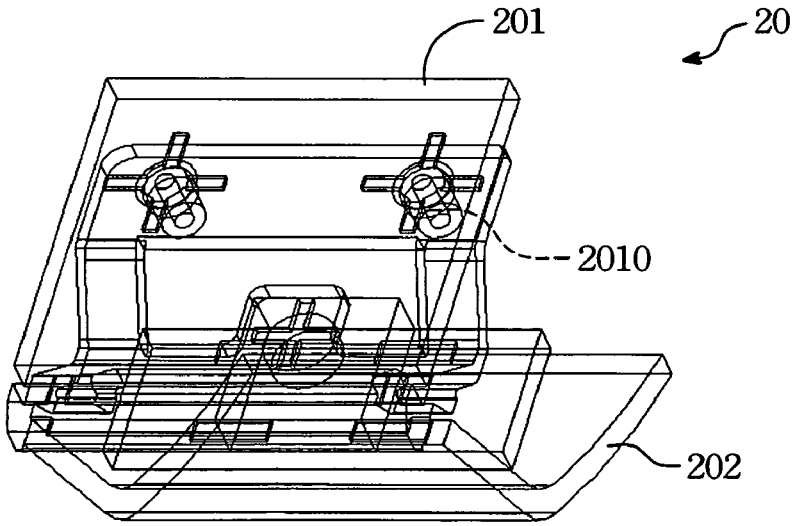
FIG. 4*b* is a transparent perspective view of the button structure of FIG. 4*a*.

Referring to FIGS. 4*a* and 4*b*, an exploded view and a assembled view of the button structure 20 of the present invention are shown, respectively. As shown, the kinetic energy transferring element 203 of the button structure 20 is used for pressing the electric switch 2041 and has a curved portion 31, a first extended portion 32 and a second extended portion 33. The first extended portion 32 is served as the fulcrum of the kinetic energy transferring element 203, while the second extended portion 31 is served as the part to directly receive the user's application. When the user presses the second extended portion 33, the pressing power will make the curved portion 31 of the kinetic energy transferring element 203 to protrude and thus touch downward the electric switch 2041.

The button structure 20 includes the up-housing 201 and the down-housing 202. The up-housing 201 has least a hot-melt-pillar 2010 to pair tightly the hole of combine with the first extended portion 32. Alternatively, screws or other fastener elements can be used to mount the first extended portion 32 to the up-housing 201 through the holes of the first extended portion 32. In the embodiment, the polygon edge 331 providing a plurality of the touching face 3321 is shown to have at least three faces to which the user can apply. When the user presses any of the three touching faces 3321 as clearly shown in FIG. 4*a*, the pressing power can be forwarded to the protruded portion 311 of the curved portion 31 so as to have the protruded portion 311 protrude downward and touch the electric switch 2041.

In another embodiment, the kinetic energy transferring element can be made of an elastic plastics or metal and can be made in a unique piece. The kinetic energy transferring element can be a U shape, V shape, or W shape.

To sum up, because the conventional button structure can only receive the power from a single pressing plane, the sensitivity and user's convenience are hard to be enhanced. Also, fort the conventional button structure is a whole touch plane design, thus other switches on the printed circuit board are quite possible to be mis-touched upon meeting a careless user. On the other hand, the present invention apparently improves the foregoing disadvantages of the conventional design by providing the aforesaid kinetic energy transferring element to the button structure.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A kinetic energy transferring element applied to a button structure for pressing an electric switch, comprising a curved portion, a first extended portion, and a second extended portion, in which the curved portion is located between the first extended portion and the second extended portion; wherein said first extended portion serves as a fulcrum for the kinetic energy transferring element; wherein, when a user presses the second extended portion, the curved portion is deformed to touch the electric switch.

2. The kinetic energy transferring element according to claim 1, wherein said curved portion comprises a protruded portion for touching downward the electric switch.

3. The kinetic energy transferring element according to claim 2, wherein said protruded portion has at least a cross rib to touch the electric switch.

4. The kinetic energy transferring element according to claim 1, being made of a material selected from a group comprising elastic plastics and metals, and being made as a unique piece.

5. The kinetic energy transferring element according to claim 1, wherein said curved portion of said transferring element has a shape selected from a group comprising a U shape, a V shape, and a W shape.

6. The kinetic energy transferring element according to claim 1, wherein said electric switch is mounted electrically on a printed circuit board.

7. The kinetic energy transferring element according to claim 1, wherein said first extended portion has a plurality of holes to combine with an up housing.

8. The kinetic energy transferring element according to claim 1, wherein said second extended portion has a plurality of touching faces for the user to press thereupon.

9. A button structure in an electron device, comprising:

a kinetic energy transferring element, having a curved portion, a first extended portion and a second extended portion, in which the curved portion is located between the first extended portion and the second extended portion, the curved portion further having a protruded portion locating on bottom thereof for touching an electric switch;

a printed circuit board, having the electric switch mounted thereon, the electric switch being located to face the curved portion; and a housing, wrapping the kinetic energy transferring element and the printed circuit board, with the first extended portion protruding out of the housing; wherein said second extended portion serves as a fulcrum for the kinetic energy transferring element.

10. The button structure according to claim 9, wherein said protruded portion has at least a rib to touch the electric switch.

11. The button structure according to claim 9, wherein said kinetic energy transferring element is made of a material selected from a group comprising elastic plastics and metal, and is made as a unique piece.

12. The button structure according to claim 9, wherein said kinetic energy transferring element is shaped as a form selected from a group comprising a U shape, a V shape, and a W shape.

13. The button structure according to claim 9, wherein said housing has an up-housing and a down-housing, the up-housing having a hot-melt-pillar to combine with the first extended portion.

14. The button structure according to claim 9, wherein said second extended portion has a plurality of touching faces for a user to press thereupon.

* * * * *

UNITED STATES PATENT AND TRADEMARK OFFICE

CERTIFICATE OF CORRECTION

PATENT NO. : 7,304,257 B2 
APPLICATION NO. : 11/503904
DATED : December 4, 2007
INVENTOR(S) : Chih-Yung Chi et al.

It is certified that error appears in the above-identified patent and that said Letters Patent is hereby corrected as shown below:

On the Title page:

Item (75) "Inventors: Chih-Yung Chi, Taipei (TW); San-peng Lin, Taipei (TW); Wei Wu, Taipei (TW)" should read -- Inventors: Chih-Yung Chi, Taipei (TW); San-Peng Lin, Taipei (TW); Wei Wu, Taipei (TW) --

Signed and Sealed this

First Day of July, 2008

JON W. DUDAS
*Director of the United States Patent and Trademark Office*